US006266928B1

(12) United States Patent
Argandona

(10) Patent No.: US 6,266,928 B1
(45) Date of Patent: Jul. 31, 2001

(54) FUEL TANK SUMP CONTAINMENT APPARATUS

(76) Inventor: Toby Argandona, 21221 Running Branch Rd., Diamond Bar, CA (US) 91765

( * ) Notice: Subject to any disclaimer, the term of this patent is extended or adjusted under 35 U.S.C. 154(b) by 0 days.

(21) Appl. No.: 09/263,554

(22) Filed: Mar. 8, 1999

(51) Int. Cl.[7] ..... E02D 29/12

(52) U.S. Cl. ..... 52/20; 52/19; 52/135; 52/196; 52/169.7; 220/567.1; 220/567.2; 405/52

(58) Field of Search ..... 52/135, 192, 196, 52/169.7, 19, 20; 220/567.1, 567.2, 254, 614, 616, 681, 682, 86.1; 277/634, 636; 405/52, 133

(56) References Cited

U.S. PATENT DOCUMENTS

| | | | | |
|---|---|---|---|---|
| 4,048,766 | * | 9/1977 | Dantzer et al. | 52/19 |
| 4,302,126 | * | 11/1981 | Fier | 52/19 X |
| 4,325,405 | * | 4/1982 | Christo | 52/20 X |
| 4,659,251 | * | 4/1987 | Petter et al. | 405/52 |
| 4,822,213 | * | 4/1989 | Grace et al. | 405/303 |
| 4,896,705 | * | 1/1990 | Podgers et al. | 52/20 X |
| 4,927,290 | * | 5/1990 | Bowman | 52/20 X |
| 5,058,633 | * | 10/1991 | Sharp | 52/20 X |
| 5,148,938 | * | 9/1992 | Morgan, Jr. | 220/316 |
| 5,209,601 | * | 5/1993 | Odill et al. | 404/26 |
| 5,217,052 | * | 6/1993 | Sharp | 141/86 |
| 5,832,673 | * | 11/1998 | Cho | 52/19 |
| 6,010,029 | * | 1/2000 | Wang | 220/714 |
| 6,024,217 | * | 2/2000 | Ponsi et al. | 206/370 |
| 6,036,401 | * | 3/2000 | Morina et al. | 52/20 X |

FOREIGN PATENT DOCUMENTS

| | | | | |
|---|---|---|---|---|
| 1717730 | * | 3/1992 | (SU) | 52/20 |

* cited by examiner

*Primary Examiner*—Carl D. Friedman
*Assistant Examiner*—Phi Dieu Tran A
(74) *Attorney, Agent, or Firm*—Boniard I. Brown

(57) ABSTRACT

A sump containment apparatus for a fuel storage tank has a manhole skirt communicating with a sump interior, a bladder seal with a first portion secured in sealing engagement about an opening in the sump, and a second portion disposed about an inner surface of the manhole skirt and urged into sealing engagement with the inner surface by mechanical compression, preferably by an expansion ring. An observation port in a manhole cove is openable for viewing into the sump.

23 Claims, 2 Drawing Sheets

10
15
14

32
33
40
36
30
34
14
28
20
26
22
24
18

20A
14
20B 58
10
80
5
60
5
60
36
24
14
18
18
26
12
24
4
22
4

6
6
58
80
60
50
40
36
14
52
54
18
22
56
54

30
40
36

FUEL TANK SUMP CONTAINMENT APPARATUS

BACKGROUND AND SUMMARY OF THE INVENTION

Fuel tank installations at service stations having underground tanks, have long had the problem of water entering from the manhole structure above a tank and draining downwardly into a sump structure above a tank. The problem is particularly acute where high ground water levels of underground water tables extend to within a few inches of the ground surface.

In the prior art, sump covers have generally been utilized to prevent such water from entering the sumps, as by draining down via the manhole cover, etc., into the sump. Such sump covers are generally effective for a while after installation. However, when it is necessary to remove such cover, as for inspections, etc., workers often do not re-secure the cover correctly. Threaded fasteners have long been utilized in the installation of sump covers. In the tightening of such threaded fasteners, both in initial installation and in later closures after openings, as for periodic inspections required by law, leakage can occur. As a result of human error, uneven tightening of the threaded fasteners or screws can readily occur, as when tightening a cover or structure with a gasket or O-ring, with one screw being tightened too tightly relative to other screws, resulting in tilting of a cover with resultant leakage. Disassembly may occur, or a screw may be omitted, or a screw not tightened at all.

The present invention provides positive sealing with application of only relatively limited pressure. Positive sealing is provided at the level of the sump and higher in a manhole to prevent leakage, even when totally submerged, thus to prevent contamination of ground soil.

The present invention eliminates the sump cover of the prior art, and the problems associated therewith, and provides a bladder seal which prevents entry of water from above, as via the manhole cover or other leakage into the sump, typically caused by high ground water level leakage. The manhole cover and its annular resilient seal normally prevent such entry.

Improved positive sealing according to the invention is provided by a manhole skirt communicating with the interior of a sump, and a bladder seal having spaced-apart first and second portions, and a bladder portion therebetween the first portions being secured in sealing engagement with an upper surface of the sump, and the second portion of the bladder seal being sealingly engaged by being compressed about an inner surface of the manhole wall. The first bladder seal portion is preferably secured by clamped engagement with a flange portion disposed about a sump opening communicating with the manhole skirt, and the second bladder seal portion is preferably sealingly engaged with the manhole wall by an expansion ring with segments urged apart by expansion bolt mechanisms.

An observation port opening in the manhole cover is closable by a lid member which is opened and closed by operation of a latch mechanism. With the observation port open, the sump interior is readily viewed to ascertain whether or not water has entered thereinto from above. The observation port eliminates any necessity for the opening and lifting of a heavy manhole cover, normally requiring two persons, then reaching down and removing a sump cover by removing threaded fasteners, etc., in order to determine whether there is water in the sump.

DESCRIPTION OF THE PREFERRED EMBODIMENT

Figures 1, 2, 3, 4, 4A, 5:
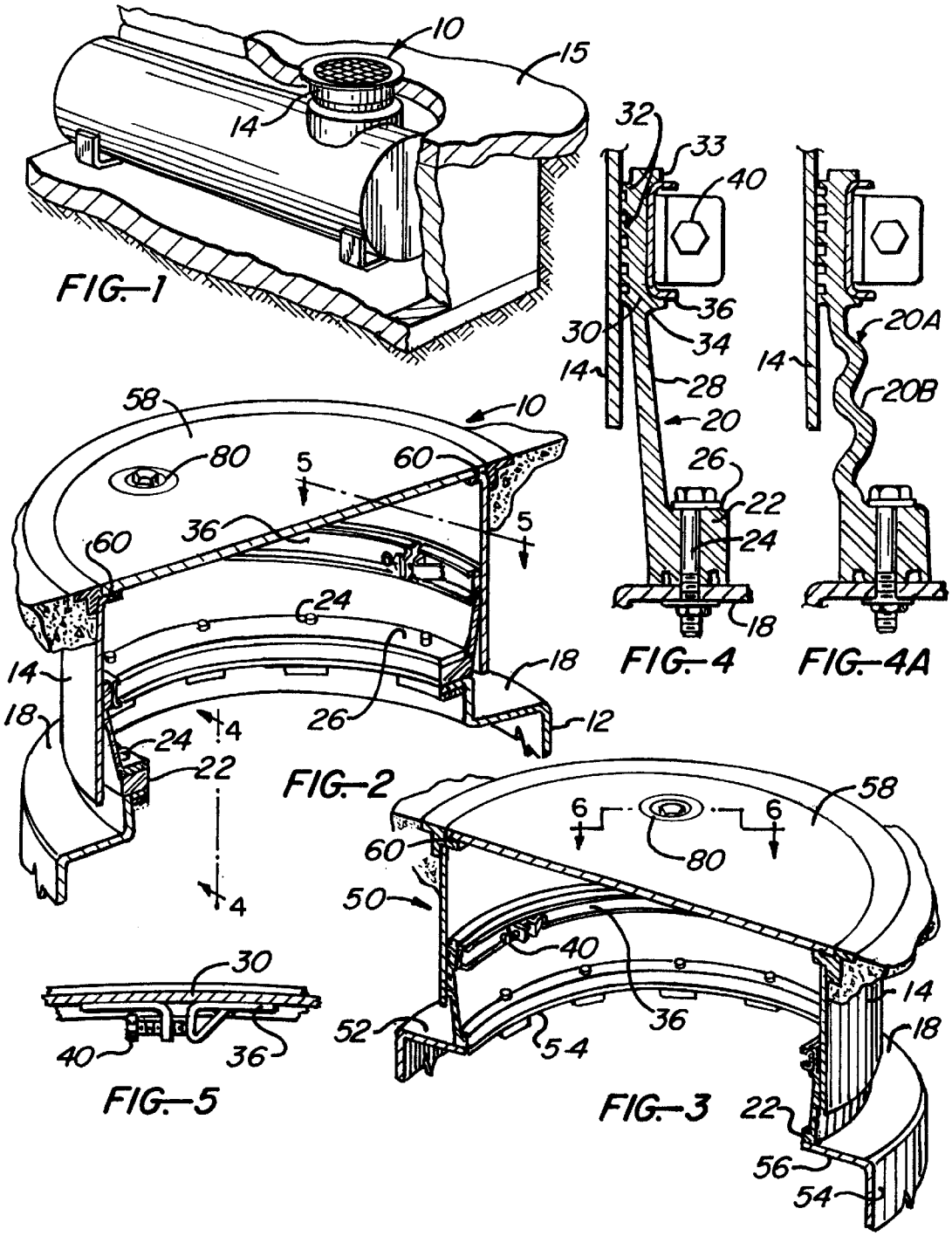
FIG. 1 is a cutaway perspective view showing apparatus of the invention in relation to an underground fuel tank and sump, with conventional concrete structure at ground level and disposed about the tank.
FIG. 2 is a cutaway perspective view of manhole and sump structures incorporating the present invention.
FIG. 3 is a cutaway perspective view of a modified form of the invention.
FIG. 4 is an enlarged sectional view, taken at line 4—4 in FIG. 2.
FIG. 4A is a sectional view showing a modified form of a portion of FIG. 4.
FIG. 5 is an enlarged sectional view, taken at line 5—5 in FIG. 2.

Referring to the drawings, FIGS. 1 and 2 show a preferred embodiment of apparatus 10 according to the invention mounted atop a sump 12 in an underground fuel tank.

A manhole having a wall or skirt 14 is disposed on the sump and supported by engagement of upper ring member with the concrete pavement 15, as shown. The concrete pavement is disposed about the manhole upper member and concrete walls and flooring are disposed about the tank.

A bladder seal 20, typically fabricated of rubber, has an enlarged first base portion 22 with openings therethrough to receive bolts 24. A mounting ring 26 is positioned atop the first portion 22 which is seated on an inwardly extending flange 18 of sump 12. Bolts 24 cooperate with nuts threaded thereon at the lower side of the flange to clamp the components together to provide positive sealing to prevent entry of water into the sump. The bladder seal 20 has a central bladder portion 28 and an upper second portion 30 (FIG. 4) which defines a plurality of sealing ribs 32 adapted to extend about and sealingly engage the inner surface of the wall 14, thus to provide multiple seals. Parallel ridges 33, 34 are also defined in upper portion 30, as shown.

An expansion ring 36, comprising three arcuate sections, is disposed between annular ridges 33, 34 of the upper seal portion, and is adapted to fit about the interior surface of manhole skirt 14. Conventional expansion bolt assemblies (FIG. 5) are disposed on adjacent end portions of the arcuate sections. Expansion of the arcuate sections relative to each other, by operation of bolt member 40, exerts compressive force on the bladder seal upper second section 30 to provide sealing engagement with the inner wall of manhole skirt 14, thereby providing positive sealing by the multiple sealing ribs 32.

Shown in FIG. 4A is a modified form of bladder seal **20*a* with a bladder portion 28*a* of serpentine configuration to enable elongation thereof with rising of manhole skirt 14** caused by rising of the ground surface level under frost or freezing conditions.

It will be understood from the foregoing that positive sealing is provided by the first portion 22 of the bladder seal at the sump, and that positive sealing is also provided at the higher level of the multiple sealing ribs of the upper bladder portion 30, thus to prevent water entering the sump, particularly from above.

FIG. 3 illustrates a modified form 50 of the apparatus of the invention, which is adapted for mounting on a pre-existing sump installation which has been modified by the cutting of an opening in a pre-existing upper sump wall 52, along a circular line 54, and by clamping the lower first portion 22 of the bladder seal to a remaining inwardly extending sump flange 56. The structure and function of the apparatus of this embodiment is otherwise like that of the embodiment of FIGS. 1 and 2.

In both the embodiment of FIG. 1 and the embodiment of FIG. 3, a manhole cover 58 and an annular sealing ring 60, disposed in a groove in a flange at the upper end portion of skirt 14 provide positive sealing against entry of water.

Figure 6:
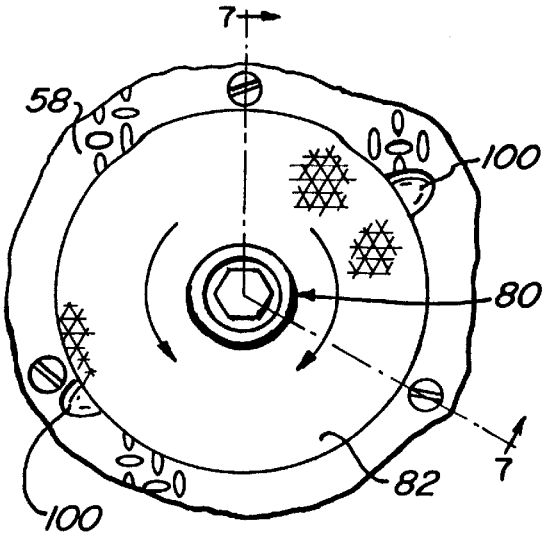
FIG. 6 is a fragmentary view of a portion of the manhole cover with a cover plate therein according to the invention.
Figure 3A:
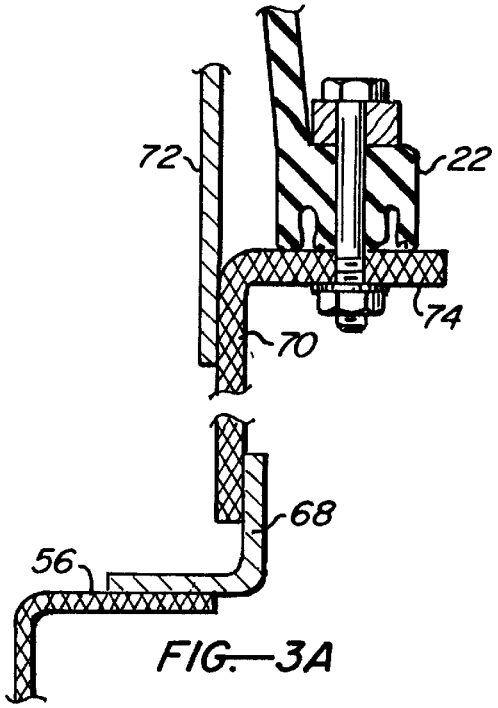
FIG. 3A is a sectional view of a modified form of a portion of the embodiment of the invention shown in FIG. 3.
Figure 7:
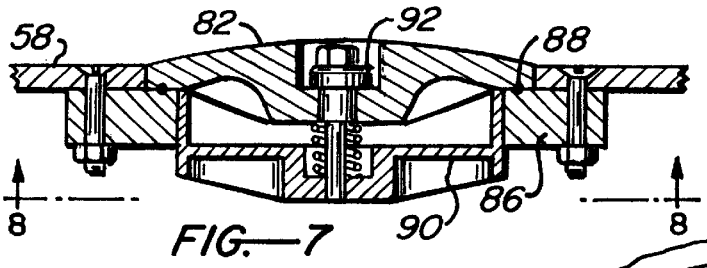
FIG. 7 is a sectional view taken at line 7—7 in FIG. 6.
Figure 8:
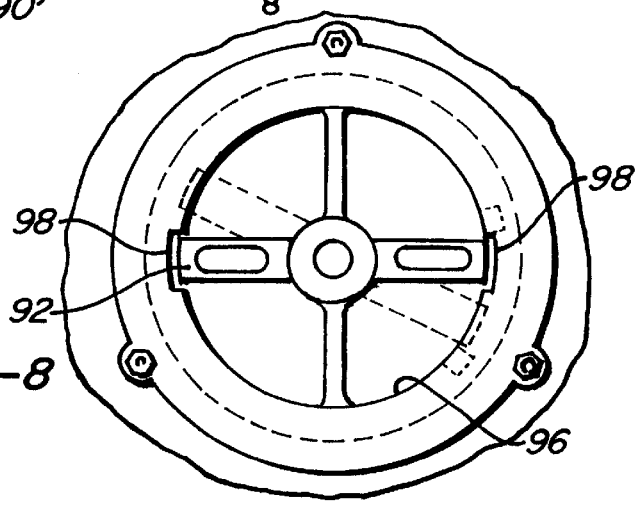
FIG. 8 is a view taken at line 8—8 in FIG. 7.

An observation port structure 80 (FIGS. 6 to 8) comprises a lid plate 82 disposed in a circular opening in a manhole cover 58. The lid plate is sealingly engaged with a latch body 86 by an O-ring 88 secured by a cam lock latch body. Latch member 90 is movable or pivotable by rotation of member 93 by an appropriate wrench. The latch member may thus be moved or rotated to a latched position wherein end portions 92, 94 are moved into engagement under a circular flange 96, or into an unlatched position (shown in FIG. 8) when the latch end portions are in registration with recesses 98 in the flange, thus enabling the lifting of the assembly comprising the lid plate and the latch member through the opening 84. Recesses 100, provided in the manhole cover adjacent to the ring plate, are accessed by a tool to pry open the lid plate when necessary.

With this assembly removed from the opening, a person may readily observe the sump interior to ascertain whether or not there is liquid therein, and whether any other problem may exist.

Substantial savings of time and cost are provided by provision of the observation port. Typically, in the prior art, two persons are required in the lifting of a heavy manhole cover, typically weighing 100 lbs. or substantially more, in order to remove the manhole cover, and two persons being required by OSHA regulations requiring two persons to lift over 50 lbs. These persons must also remove a conventional sump cover which involves removal of screws through threaded fasteners, and reaching far down to the sump cover.

By eliminating the prior art sump cover, and providing the observation port, the task of removing a manhole cover, and removing a sump cover in order to observe whether there is liquid under the sump, are eliminated.

Thus there has been shown and described a fuel tank sump containment apparatus which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Sump containment apparatus for a fuel storage tank wherein a manhole and sump are disposed thereatop, comprising:

a manhole structure including a skirt extending into general proximity with the sump and communicating with the interior of the sump, a resilient bladder seal having first and second spaced-apart portions, said first bladder seal portion being in sealing engagement with an upper portion of the sump, and said second portion of said bladder seal being sealingly engaged about an inner wall surface of the manhole, whereby positive fluid sealing is provided between the bladder seal, the sump, and the interior surface of the manhole wall to prevent entry of water into the sump.

2. Apparatus according to claim 1, wherein an opening is defined in a top portion of the sump and said first portion of the bladder seal is in sealing engagement with the sump top portion about said opening.

3. Apparatus according to claim 1, wherein said bladder seal second portion is compressed in sealing engagement with an inner surface of the manhole wall.

4. Apparatus according to claim 1, and further including:

a manhole skirt having an upper end portion closed by a manhole cover in sealing engagement with the skirt upper end portion.

5. Apparatus according to claim 1, wherein:

said manhole structure comprises a cover having an observation port opening, and further comprising a lid disposed in said opening, a latch body disposed on the manhole cover and sealingly engagable with the lid, a latch mechanism operable to cooperate with the latch body to latch and unlatch the lid plate relative to the manhole cover, and an operating member connected with the latch member and extending through the lid plate for movement of the latch mechanism between latch to unlatch positions.

6. Sump containment apparatus for a fuel storage tank, comprising:

a manhole having a cover, a manhole skirt disposed above and extending into general proximity with a sump, a bladder seal having first and second spaced apart portions and a bladder portion therebetween, said first portion of the bladder seal being secured in sealing engagement with a sump upper portion about an opening in the sump, and said second portion of the bladder seal being spaced from said first portion and mechanically compressed in sealing engagement with an inner surface of the manhole wall, whereby positive fluid sealing is provided between the bladder seal, the sump, and the interior surface of the manhole wall to prevent entry of water into the sump.

7. Apparatus according to claim 6, wherein said bladder portion of the bladder seal is undulated in configuration for elongation thereof upon rising of the manhole skirt with rising of ground surface level caused by cold and frost conditions.

8. Apparatus according to claim 6 and further including:

a manhole cover atop the manhole skirt, and a resilient annular seal member between the manhole cover and an upper end portion of the manhole skirt.

9. Apparatus according to claim 8, wherein:

said sump has an upper opening defined by a flange, and said manhole skirt is supported by concrete flooring disposed about the manhole.

10. Apparatus according to claim 6, and further including:

an expansion ring assembly expanding against said second bladder seal portion to compress the second bladder seal portion against an inner surface of the manhole skirt.

11. Apparatus according to claim 10, wherein said bladder portion of the bladder seal is undulated in configuration for elongation rising thereof upon rising of the manhole skirt with rising of ground surface level caused by cold and frost conditions.

12. Apparatus according to claim 10 and further comprising:

a latch body secured on the lower side of the manhole cover about an observation port opening therein, a lid plate fitting said opening and sealingly engaging the latch body about the opening, a latch member movable relative to the latch body and engaging a flange of the latch body, an operating member rotatable relative to the lid plate and connected with the latch member for movement between a position wherein the latch member is engaged with the flange of the latch body, and a position wherein the latch member is in registration with at least one recess in said flange to allow removal of the lid plate and latch member from the opening to enable viewing the interior of the sump.

13. Apparatus according to claim 6, wherein:

said sump has an upper opening defined by a flange, and said manhole skirt is supported by concrete flooring disposed about the manhole.

14. Apparatus according to claim 13, and further including:

an expansion ring assembly expanding against said second bladder seal portion to compress the second bladder seal portion against an inner surface of the manhole skirt.

15. Apparatus according to claim 13, and further comprising:

a latch body secured on the lower side of the manhole cover about an observation port opening therein, a lid plate fitting said opening and sealingly engaging the latch body about the opening, a latch member movable relative to the latch body and engaging a flange of the latch body, an operating member rotatable relative to the lid plate and connected with the latch member for movement between a position wherein the latch member is engaged with the flange of the latch body, and a position wherein the latch member is in registration with at least one recess in said flange to allow removal of the lid plate and latch member from the opening to enable viewing the interior of the sump.

16. Apparatus according to claim 6, wherein said bladder seal first portion is a lower end portion clamped in sealing relation with a sump flange about said opening in the top portion of the sump.

17. Apparatus according to claim 6, wherein second portion of the bladder seal is sealingly engaged about the inner surface of the manhole wall by an expansion ring comprising arcuate segments urgable apart by at least one expansion bolt assembly to compress the second bladder seal portion against said inner surface of the manhole wall.

18. Apparatus according to claim 6, wherein:

said sump and said manhole skirt are generally cylindrical.

19. Apparatus according to claim 6, and further including:

a clamp ring disposed atop a portion of said lower bladder seal portion, and said clamp ring, sump wall portion, and said first bladder seal portion are clamped in sealing relation by threaded fasteners.

20. Apparatus according to claim 19 wherein said first bladder seal portion receives threaded fasteners therethrough for securement to the sump wall portion.

21. Apparatus according to claim 6, wherein:

said manhole cover has an observation port opening and further comprising a lid disposed in said opening, a latch body disposed on the manhole cover and sealingly engagable with the lid, a latch mechanism operable to cooperate with the latch body to latch and unlatch the lid plate relative to the manhole cover, and an operating member connected with the latch member and extending through the lid plate for movement of the latch mechanism between latched to unlatched positions.

22. Apparatus according to claim 6, and further comprising:

a latch body secured on the lower side of the manhole cover about an observation port opening therein, a lid plate fitting said opening and sealingly engaging the latch body about the opening, a latch member movable relative to the latch body and engaging a flange of the latch body, an operating member rotatable relative to the lid plate and connected with the latch member for movement between a position wherein the latch member is engaged with the flange of the latch body, and a position wherein the latch member is in registration with at least one recess in said flange to allow removal of the lid plate and latch member from the opening to enable viewing the interior of the sump.

23. Apparatus according to claim 22, wherein the latch member has oppositely extending arms engaging the latch body flange and to register with two spaced-apart flange recesses.

* * * * *